US010830538B2

(12) United States Patent
Snider et al.

(10) Patent No.: US 10,830,538 B2
(45) Date of Patent: Nov. 10, 2020

(54) VARIABLE CIRCUITRY HEAT EXCHANGER SYSTEM

(71) Applicant: Johnson Controls Technology Company, Auburn Hills, MI (US)

(72) Inventors: Ryan L. Snider, York, PA (US); Nicholas P. Mislak, Bel Air, MD (US); Kristen Velez-Diaz, York, PA (US); Kevin R. Stockton, York, PA (US); Stacy S. Lemkelde, York, PA (US); Douglas A. Kester, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 149 days.

(21) Appl. No.: 15/937,630

(22) Filed: Mar. 27, 2018

(65) Prior Publication Data

US 2019/0285348 A1 Sep. 19, 2019

Related U.S. Application Data

(60) Provisional application No. 62/642,943, filed on Mar. 14, 2018.

(51) Int. Cl.

| | |
|---|---|
| ***F28D 1/04*** | (2006.01) |
| ***F24F 11/70*** | (2018.01) |
| ***F25B 29/00*** | (2006.01) |
| ***F28D 21/00*** | (2006.01) |
| ***F28F 1/10*** | (2006.01) |
| ***F25B 41/04*** | (2006.01) |
| ***F24F 140/50*** | (2018.01) |
| ***F25B 30/02*** | (2006.01) |
| *F24F 3/00* | (2006.01) |

(52) U.S. Cl.

CPC ..... *F28D 1/0417* (2013.01); *F24F 11/70* (2018.01); *F25B 29/003* (2013.01); *F25B 30/02* (2013.01); *F25B 41/04* (2013.01); *F28D 21/00* (2013.01); *F28F 1/10* (2013.01); *F24F 3/001* (2013.01); *F24F 2140/50* (2018.01); *F25B 2313/02731* (2013.01); *F28D 2021/0068* (2013.01)

(58) Field of Classification Search

CPC ..... F28D 1/0417; F25B 41/04; F25B 2313/02731; F25B 30/02; F28F 1/10

See application file for complete search history.

(56) References Cited

U.S. PATENT DOCUMENTS

| | | | | |
|---|---|---|---|---|
| 3,990,504 | A * | 11/1976 | Kolthoff, Jr. | F28D 1/05341 165/271 |
| 5,101,640 | A * | 4/1992 | Fukushima | F25B 49/027 62/196.4 |
| 8,881,541 | B2 | 11/2014 | Noll et al. | |
| 2010/0281894 | A1 | 11/2010 | Huff | |
| 2015/0122455 | A1 | 5/2015 | Fox et al. | |
| 2015/0216087 | A1 | 7/2015 | Madara et al. | |
| 2017/0030619 | A1* | 2/2017 | Kim | F25B 5/04 |

FOREIGN PATENT DOCUMENTS

WO 2014172268 A2 10/2014

* cited by examiner

*Primary Examiner* — Ana M Vazquez

(74) *Attorney, Agent, or Firm* — Fletcher Yoder, P.C.

(57) ABSTRACT

A heat exchanger that includes a plurality of conduits that transmit a refrigerant therethrough. A valve that actuates to fluidly couple a first set of conduits of the plurality of conduits in a first setting and fluidly couple a second set of conduits of the plurality of conduits in a second setting.

20 Claims, 10 Drawing Sheets

120

VARIABLE CIRCUITRY HEAT EXCHANGER SYSTEM

CROSS-REFERENCE TO RELATED APPLICATION

This application is a Non-Provisional Application claiming priority to U.S. Provisional Application No. 62/642,943, entitled "VARIABLE CIRCUITRY HEAT EXCHANGER SYSTEM," filed Mar. 14, 2018, which is hereby incorporated by reference in its entirety for all purposes.

BACKGROUND

The invention relates generally to heat exchangers in vapor compression systems.

Heat exchangers are used in heating, ventilation, and air conditioning (HVAC) systems to exchange energy between fluids. Typical HVAC systems have two heat exchangers commonly referred to as an evaporator coil and a condenser coil. The evaporator coil and the condenser coil facilitate heat transfer between air surrounding the coils and a refrigerant that flows through the coils. For example, as air passes over the evaporator coil, the air cools as it loses energy to the refrigerant passing through the evaporator coil. In contrast, the condenser facilitates the discharge of heat from the refrigerant to the surrounding air. Unfortunately, optimizing refrigerant flow paths through the coils may be difficult and time-consuming.

SUMMARY

The present disclosure relates to a heat exchanger that includes a plurality of conduits that transmit a refrigerant therethrough. A valve that actuates to fluidly couple a first set of conduits of the plurality of conduits in a first setting and fluidly couple a second set of conduits of the plurality of conduits in a second setting.

The present disclosure also relates to a heating, ventilation, and air conditioning (HVAC) system that includes a heat exchanger having a coil. The coil transmits a refrigerant fluid through a plurality of conduits. A valve fluidly couples at least two conduits of the plurality of conduits to actuate and redirect the refrigerant fluid through at least a subset of the plurality of conduits.

The present disclosure also relates to a heating, ventilation, and air conditioning (HVAC) system that includes a heat exchanger coil. The heat exchanger coil includes a plurality of conduits that transmit a refrigerant therethrough. A fin couples to the plurality of conduits. A valve fluidly couples to the plurality of conduits. The valve actuates and adjusts a flow path of the refrigerant through a subset of the plurality of conduits.

DRAWINGS

DETAILED DESCRIPTION

Maldistribution of refrigerant in a heat exchanger coil and/or maldistribution of airflow over the heat exchanger coil may affect heat transfer between the refrigerant and the surrounding air. Because of the potential for maldistribution of refrigerant and/or airflow, typical heat exchanger coils undergo various testing to determine a fixed refrigerant flow path(s) through the heat exchanger coil. More specifically, during testing, the conduits in the heat exchanger coil may be connected to each other in different ways to determine one or more potential or desired pathways through the heat exchanger coil. Once the desired flow path(s) are determined, the heat exchanger coil is mass-produced by connecting conduits to connectors via brazing and/or welding. Thus, in order to change a flow path, such as for a different operating condition, the connectors would be removed and then rebrazed and/or welded to different conduits.

Embodiments of the present disclosure include a variable circuitry heat exchanger system configured to change fluid flow paths through a heat exchanger coil in real time. More specifically, the variable circuitry heat exchanger is configured to modify one or more fluid flow paths through the heat exchanger coil by opening and closing valves of the heat exchanger. Opening and closing valves enables the variable circuitry heat exchanger system to lengthen a fluid flow path by including additional heat exchanger conduits in the fluid flow path, shorten a fluid flow path by blocking off one or more conduits, and/or by closing off one or more fluid flow paths. Varying the flow path(s) through the heat exchanger coil with the variable circuitry heat exchanger system enables heat transfer optimization in response to an operating condition of the HVAC system. In other words, the ability to modify or adjust the length of flow paths in the heat exchanger may optimize heat transfer when the HVAC system is operating at, for example, 100%, 75%, or 50% of its capacity. Similarly, the ability to modify or adjust the length of a heat exchanger flow path may enable heat transfer optimization across different modes of operation, such as startup, shutdown, and steady state operation.

Figure 1:
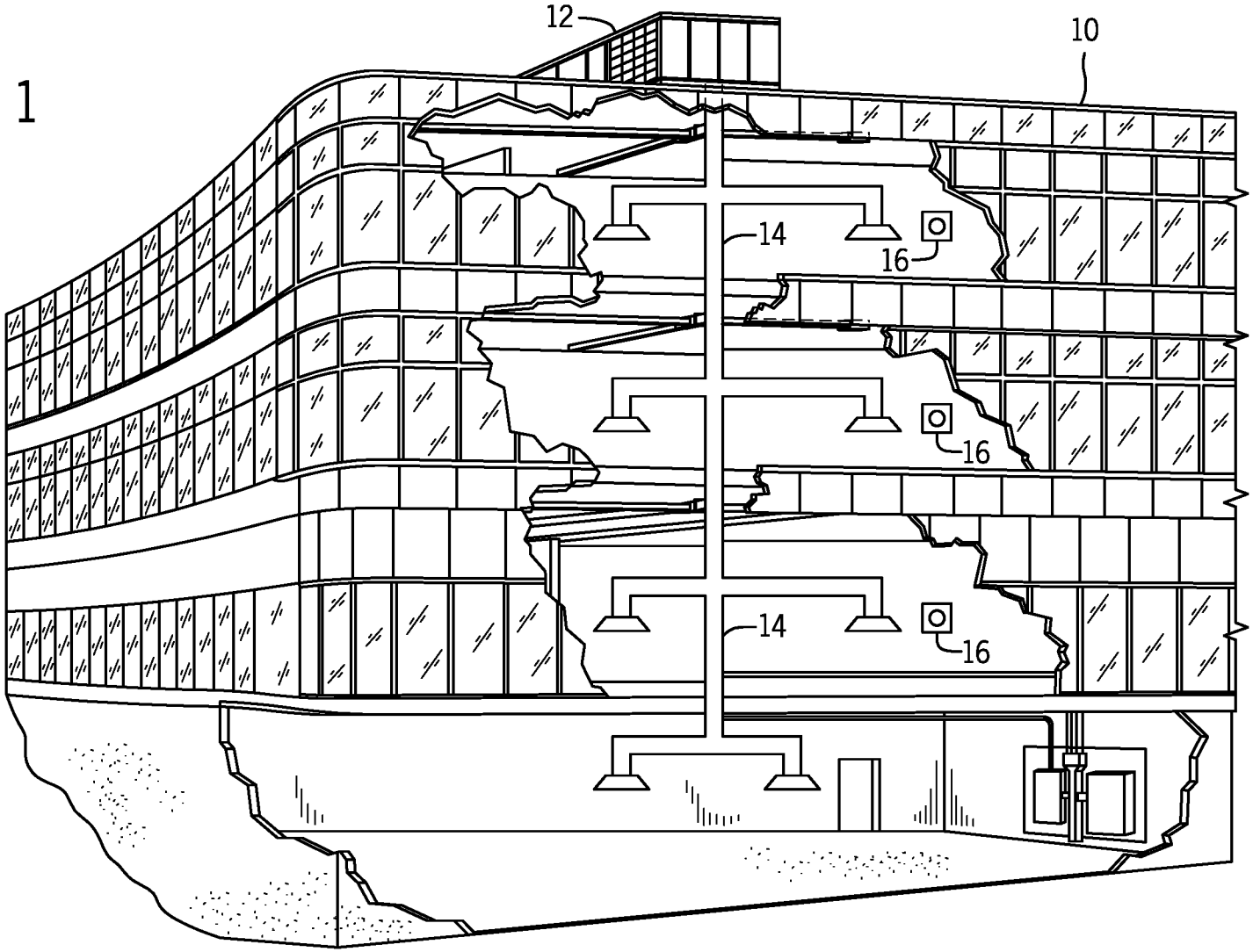
FIG. 1 is a perspective view of an embodiment of a building that may utilize a heating, ventilation, and air conditioning (HVAC) system in a commercial setting, in accordance with an aspect of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
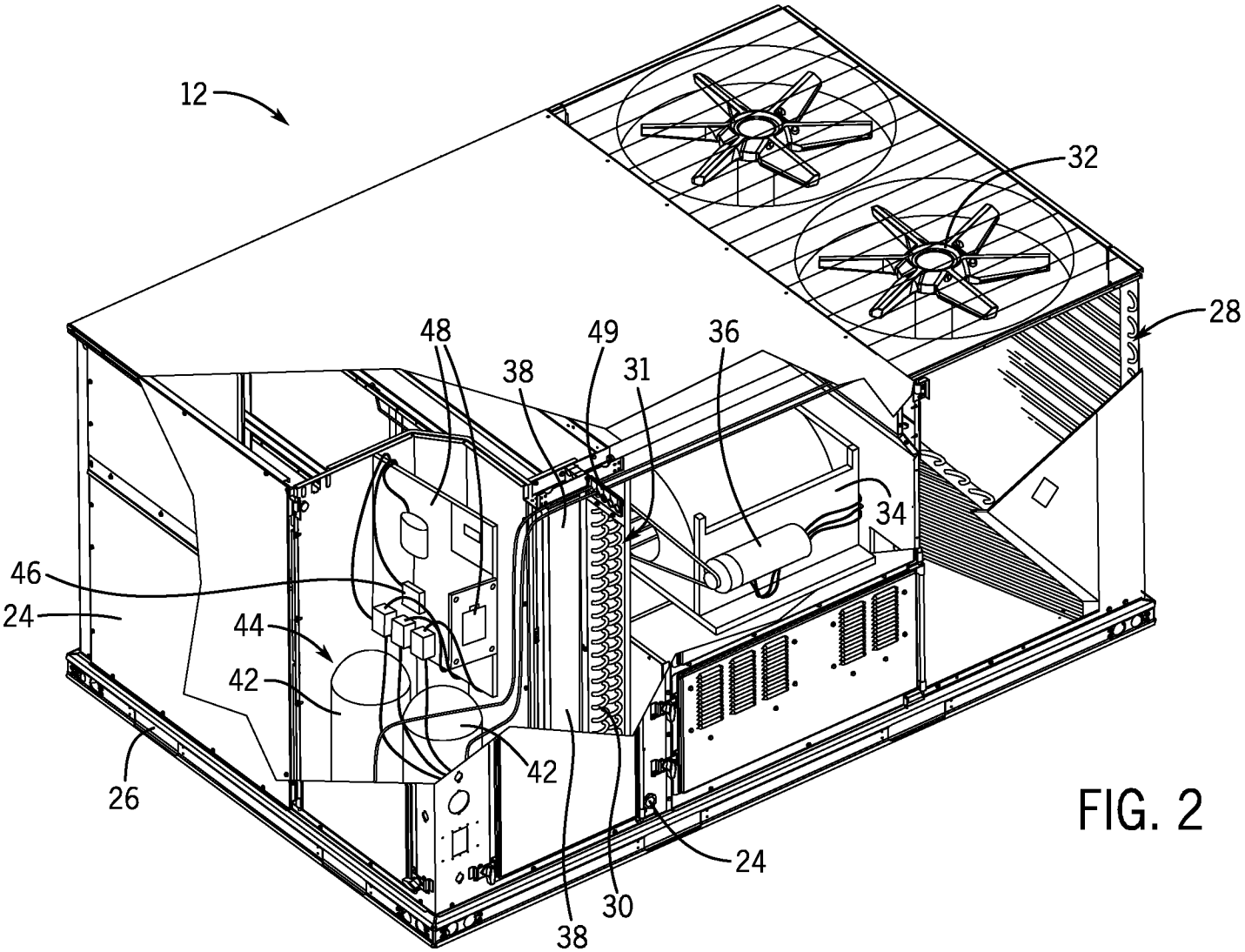
FIG. 2 is a perspective view of an embodiment of an HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive him arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
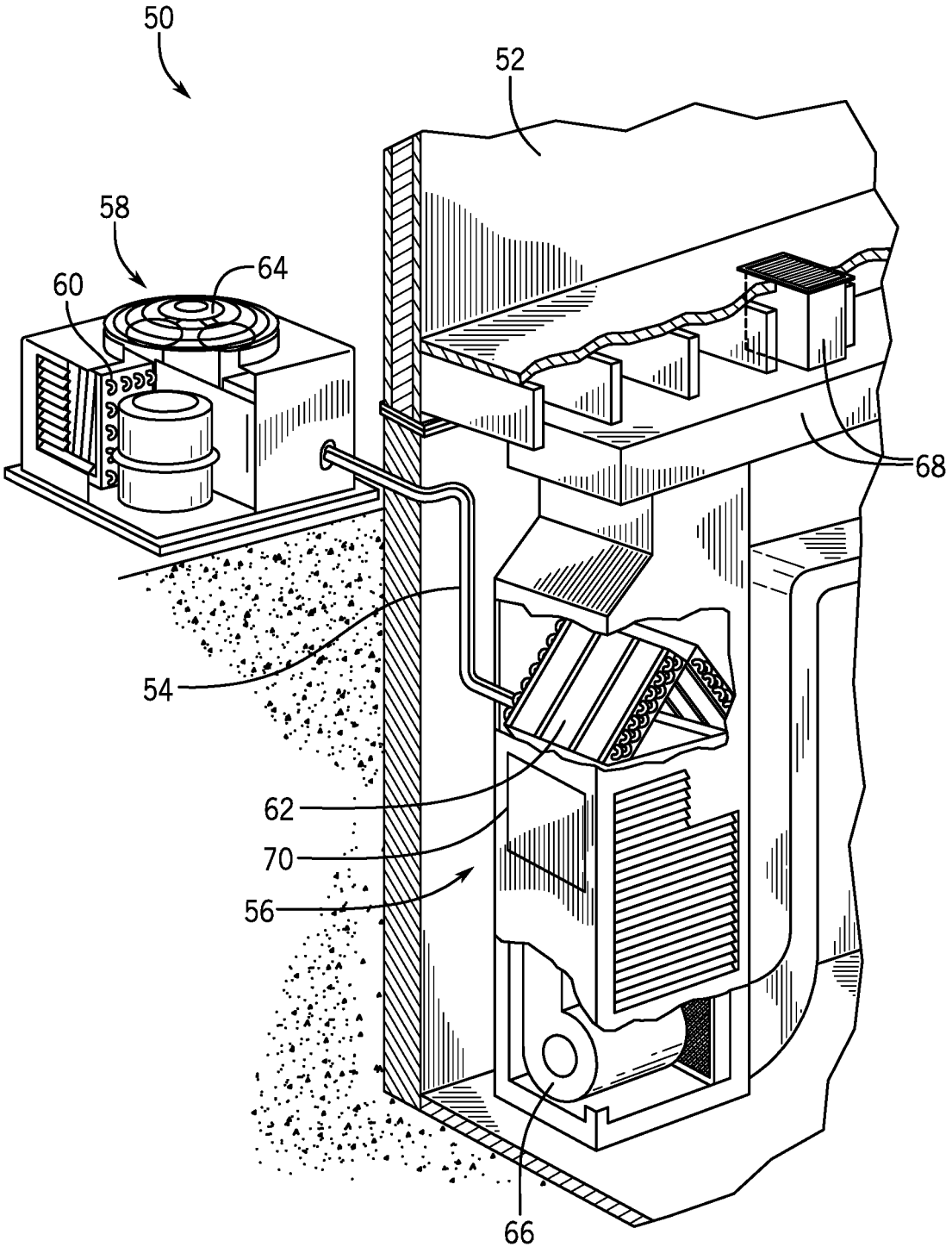
FIG. 3 is a perspective view of an embodiment of a residential, split HVAC system that includes an indoor HVAC unit and an outdoor HVAC unit, in accordance with an aspect of the present disclosure.

FIG. 3 illustrates a residential heating and cooling system 50 in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
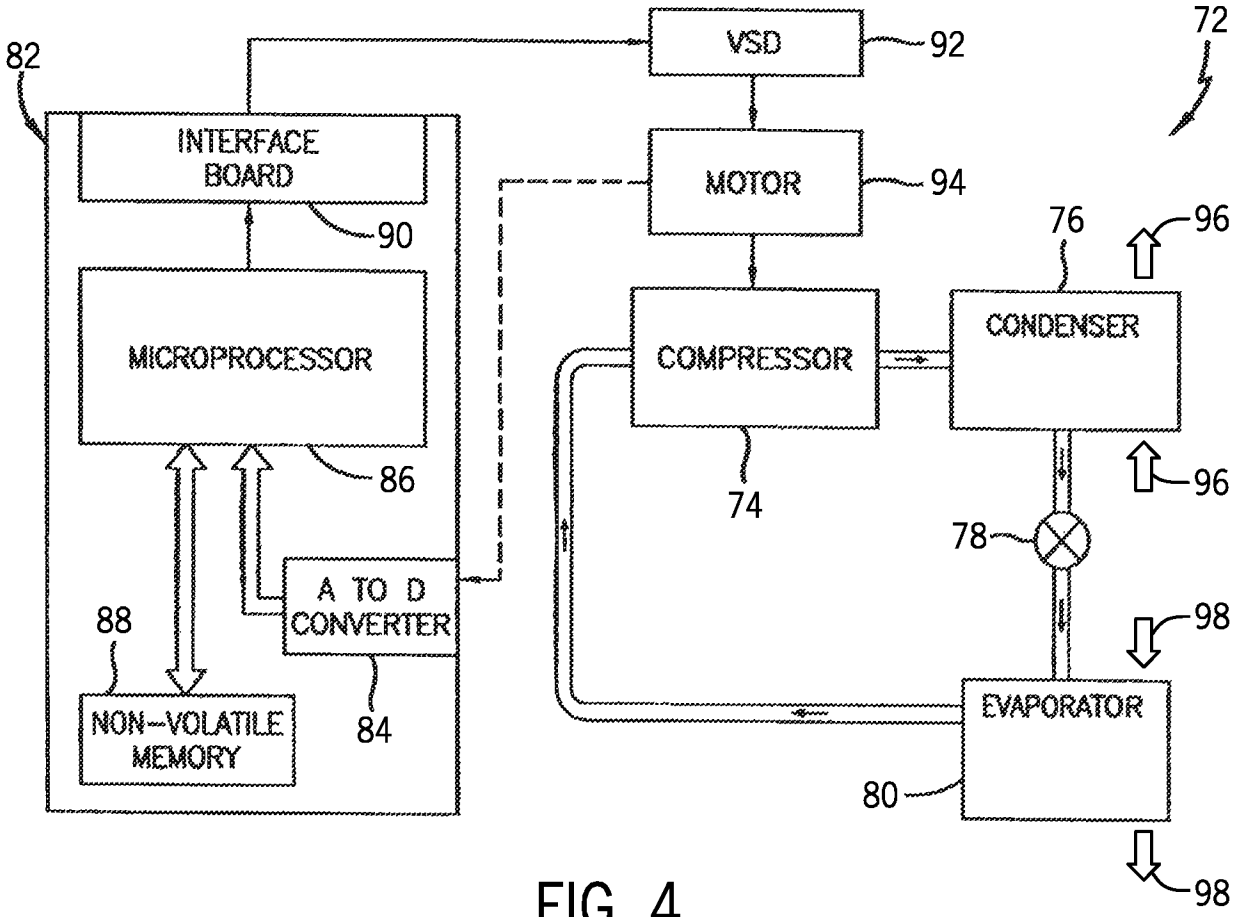
FIG. 4 is a schematic of an embodiment of an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a nonvolatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
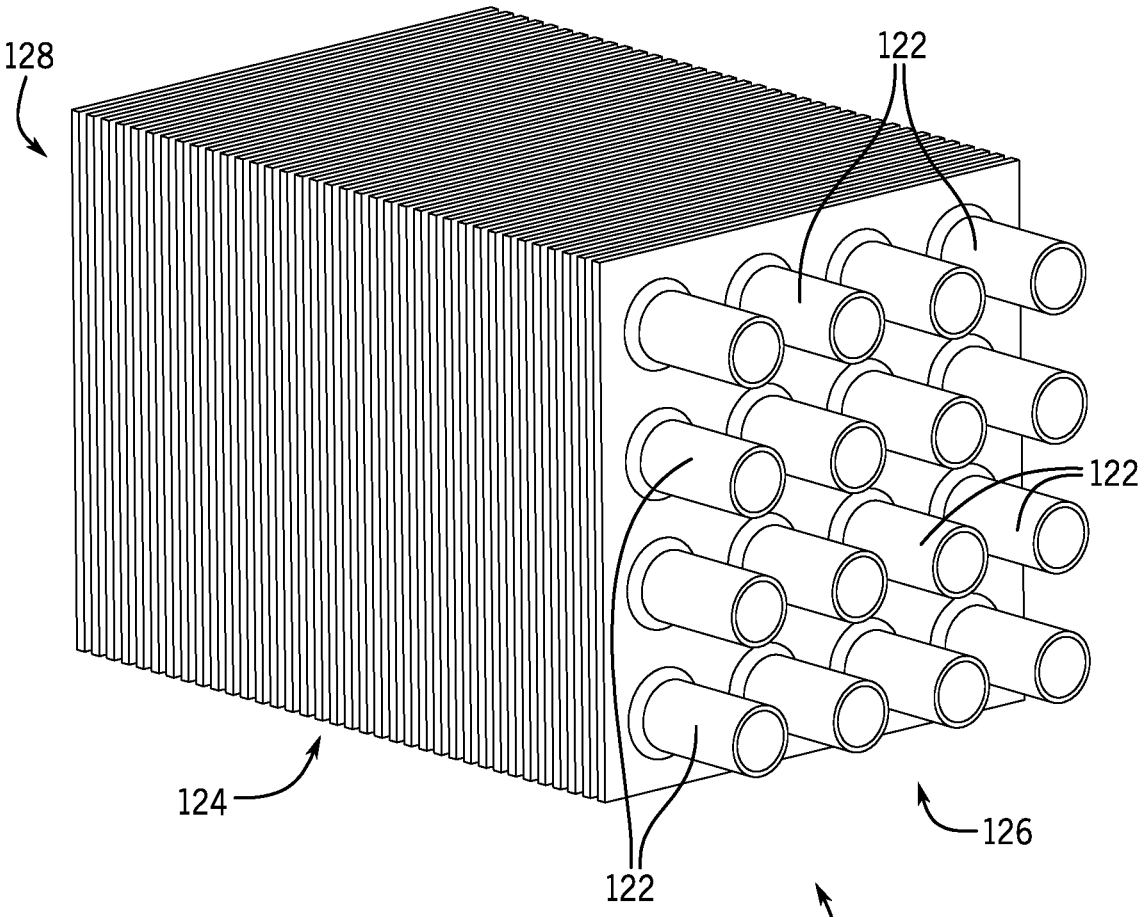
FIG. 5 is a perspective view of an embodiment of a heat exchanger coil, in accordance with an aspect of the present disclosure.

FIG. 5 is a perspective view of an embodiment of a heat exchanger coil 120, such as an evaporator coil or a condenser coil. As illustrated, the heat exchanger coil 120 includes a plurality of conduits 122. The conduits 122 extend through one or more fins 124 that facilitate heat transfer between a refrigerant flowing through the conduits 122 and air passing over the fins 124. The conduits 122 may also referred to as passes that channel the fluid through the heat exchanger coil 120.

In FIG. 5, the conduits 122 do not fluidly couple to one another and therefore each conduit 122 includes opposing open ends 126, 128. During the manufacturing process, connectors couple to opposing ends 126, 128 to one another to form one or more flow paths through the heat exchanger coil 120. That is, the conduits 122 fluidly couple together with connectors to enable refrigerant to circulate within the heat exchanger coil 120. Maldistribution of the refrigerant in the heat exchanger coil 120 and/or maldistribution of airflow over the heat exchanger coil 120 may affect heat transfer between the refrigerant and the surrounding air. The conduits 122 may therefore be fluidly coupled to each other in specific ways or configurations that optimize heat transfer. Unfortunately, in traditional embodiments, the connectors are typically brazed or otherwise connected in a way that limits the ability to change one or more flow paths through the heat exchanger coil 120.

Figure 6:
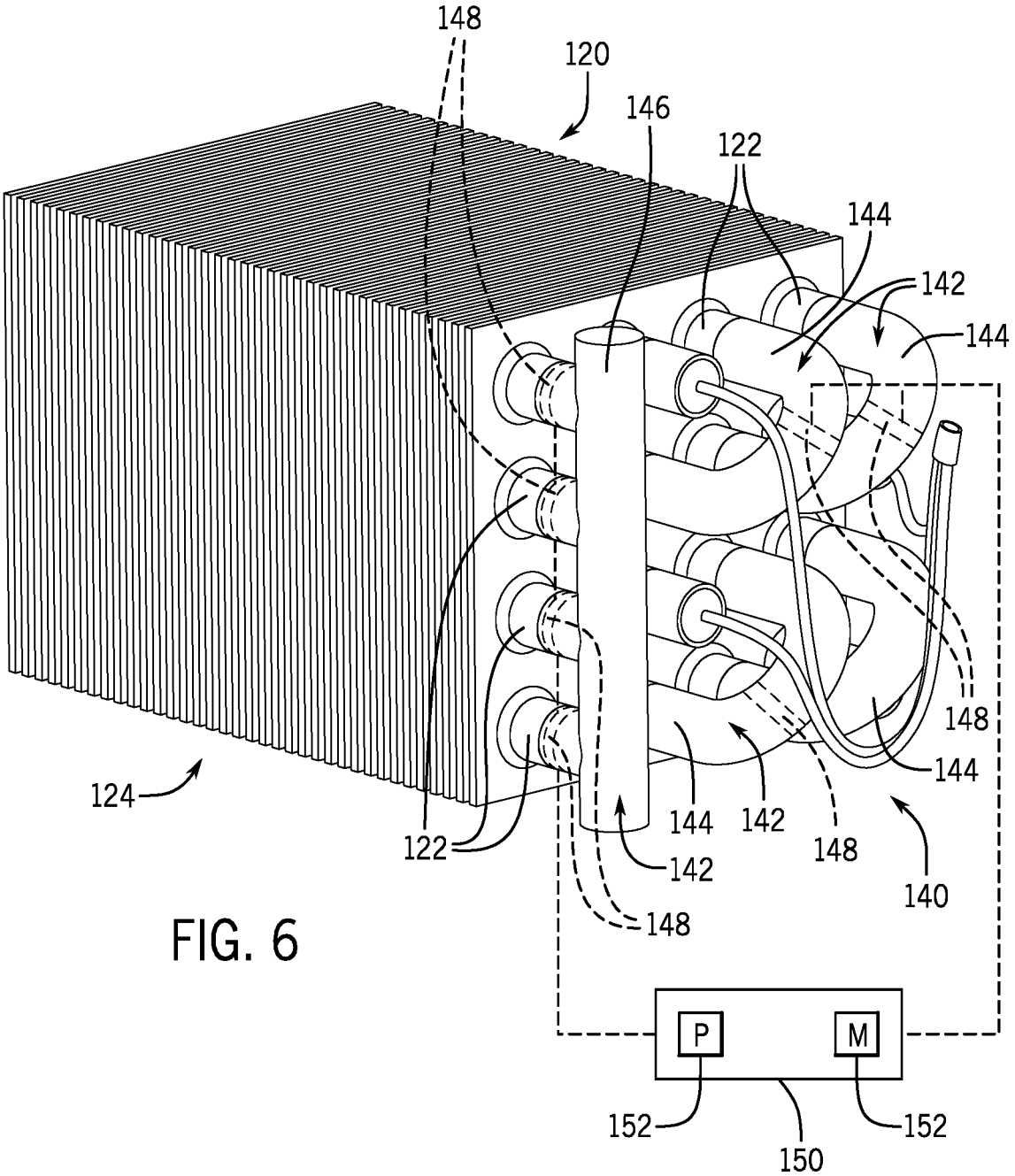
FIG. 6 is a perspective view of an embodiment of a variable circuitry heat exchanger system, in accordance with an aspect of the present disclosure.

FIG. 6 is a perspective view of an embodiment of a variable circuitry heat exchanger system 140. It should be understood that the term "variable circuitry heat exchanger system" as used in this application, includes a system with the ability to change one or more refrigerant flow paths through a heat exchanger without removing and then reconnecting connectors, manifolds, and the like, in a different way. The variable circuitry heat exchanger system 140 includes a plurality of connector assemblies 142. The connector assemblies 142 include conduits 144 and manifolds 146 that couple to conduits 122. The conduits 122 may also referred to as passes that channel the fluid through the heat exchanger system 140. In order to control the flow of refrigerant through the conduits 144 and/or manifolds 146, the connector assemblies 142 includes valves 148. The valves 148 may be placed at the ends of the conduits 144 or manifolds 146 or at a position between their ends.

The operation of these valves 148 is controlled by a controller 150. The controller 150 determines when and which valves 148 open and close. The controller 150 is therefore able to change how the refrigerant flows through the heat exchanger coil 120 without removing and then reconnecting the connectors to the conduits 122.

For example, the controller 150 may increase or decrease the number of flow paths, as well as increase or decrease the length of the flow paths through the heat exchanger coil 120. By varying the number and length of the flow path(s) through the heat exchanger coil 120, the variable circuitry heat exchanger system 140 enables heat transfer optimization as the operating conditions of the HVAC system change. As explained above, different flow paths may optimize heat transfer when the HVAC system is operating at, for example, 100%, 75%, or 50% of its capacity or in different modes of operation. Different modes of operation may include startup, shutdown, as well as steady state.

The controller 150 may include a processor 152 and a memory 154. For example, the processor 152 may be a microprocessor that executes software to control the valves 148. The processor 152 may include multiple microprocessors, one or more "general-purpose" microprocessors, one or more special-purpose microprocessors, and/or one or more application specific integrated circuits (ASICS), or some combination thereof. For example, the processor 152 may include one or more reduced instruction set (RISC) processors.

The memory 154 may include a volatile memory, such as random access memory (RAM), and/or a nonvolatile memory, such as read-only memory (ROM). The memory 154 may store a variety of information and may be used for various purposes. For example, the memory 154 may store processor executable instructions, such as firmware or software, for the processor 152 to execute. The memory may include ROM, flash memory, a hard drive, or any other suitable optical, magnetic, or solid-state storage medium, or a combination thereof. The memory may store data, instructions, and any other suitable data.

Figure 7:
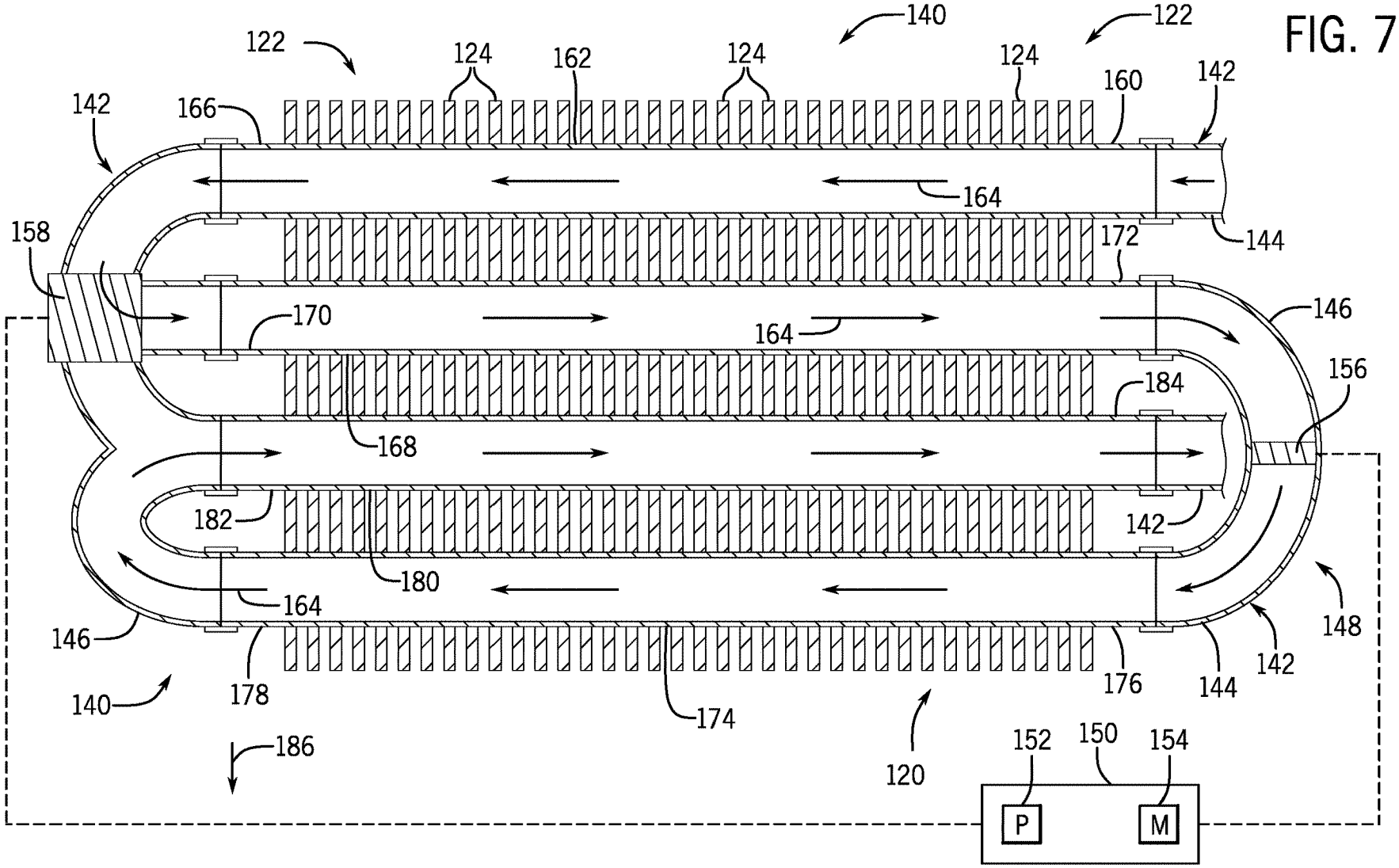
FIG. 7 is a cross-sectional view of an embodiment of a variable circuitry heat exchanger system, in accordance with an aspect of the present disclosure.

FIG. 7 is a cross-sectional view of an embodiment of the heat exchanger coil 120, illustrating a first flow path created by the variable circuitry heat exchanger system 140. As illustrated, the conduits or passes 122 overlap each other along their respective axes. The variable circuitry heat exchanger system 140 includes a plurality of the connector assemblies 142. The connector assemblies 142 form fluid tight seals with the conduits 122 through brazing, welding, or another type of connection. In operation, the connector assemblies 142 fluidly couple the conduits 122 together to form one or more flow paths through the heat exchanger coil 120. The flow of refrigerant through the connector assemblies 142 is regulated with the valves 148. For purposes of illustration, the variable circuitry heat exchanger system 140 in FIG. 7 includes two different types of valves 148: a two-way valve 156 and a three-way valve 158. It should be understood that other embodiments may include different numbers of valves 148, such as 1, 2, 3, 4, 5, or more valves, as well as different types of valves.

As illustrated, one connector assembly 142 may couple to an inlet 160 of a first conduit 162, thereby enabling refrigerant 164 to flow into the heat exchanger coil 120. The first conduit 162 guides the refrigerant 164 from the inlet 160 to an outlet 166, where another connector assembly 142 fluidly couples the first conduit 162 to a second conduit 168. The refrigerant 164 then flows from an inlet 170 of the second conduit 168 to an outlet 172. Refrigerant 164 is then directed through another connector assembly 142 to a fourth conduit 174. The refrigerant flows through the fourth conduit 174 from an inlet 176 to an outlet 178. The refrigerant 164 is then guided through another connector assembly 142 into a third conduit 180. The refrigerant 164 flows from an inlet 182 of the third conduit 180 to an outlet 184 of the third conduit 180, where the refrigerant 164 exits the heat exchanger coil 120.

In FIG. 7, the flow path through the heat exchanger coil 120 does not flow sequentially through the conduits 122 in axial direction 186. Instead, the refrigerant 164 flows from the second conduit 168 to the fourth conduit 174 before returning to the third conduit 180. Previously, any change to the flow path through the heat exchanger coil 120 would have involved disconnecting the connector assemblies 142 and then reconnecting them to the conduits 122 in a different order or way. However, the variable circuitry heat exchanger system 140 enables changing one or more flow paths through the heat exchanger coil 120 in real time by including and controlling the valves 148.

Figure 8:
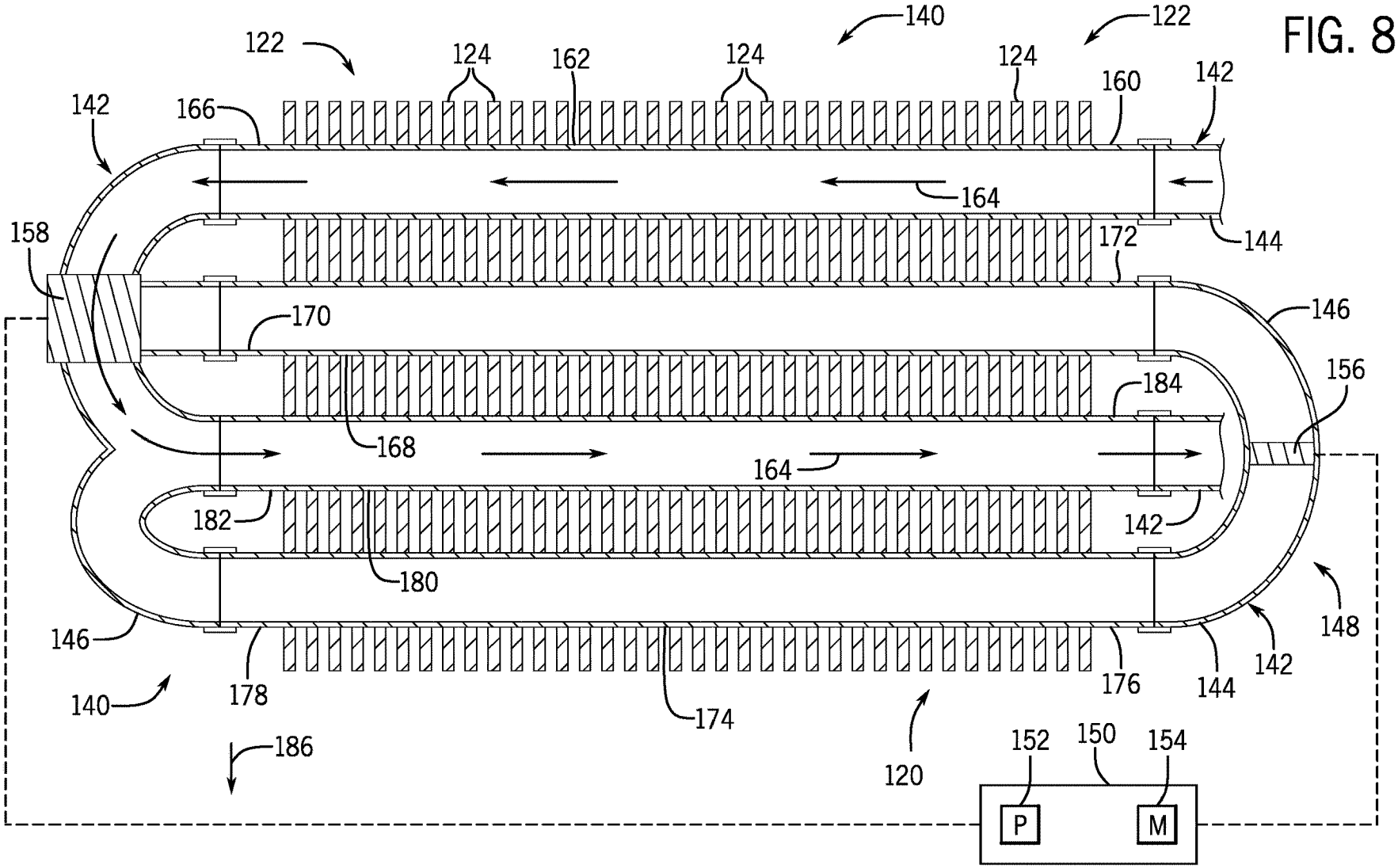
FIG. 8 is a cross-sectional view of an embodiment of a variable circuitry heat exchanger system, in accordance with an aspect of the present disclosure.

FIG. 8 is a cross-sectional view of an embodiment of the heat exchanger coil 120 illustrating a second flow path, different from the first flow path shown in FIG. 7, created by the variable circuitry heat exchanger system 140. As explained above, one connector assembly 142 couples to the inlet 160 of the first conduit 162, thereby enabling refrigerant 164 to flow into the heat exchanger coil 120. The first conduit 162 guides the refrigerant 164 from the inlet 160 to the outlet 166, where another connector assembly 142 fluidly couples the first conduit 162 to the second conduit 168 or the third conduit 180. In FIG. 7, the three-way valve 156 is positioned to direct the refrigerant 164 into the second conduit 168. However, in FIG. 8, and in response to a signal from the controller 150, the three-way valve 158 may block fluid flow into the second conduit 168, and instead redirect the refrigerant 164 into the third conduit 180. The refrigerant 164 may then flow through the third conduit 180 until it exits the heat exchanger coil 120 through the outlet 184.

To reduce the backflow of refrigerant 164 through the fourth conduit 174 and the second conduit 168, the controller 150 may also close the two-way valve 156. Without the connector assemblies 142 of the variable circuitry heat exchanger system 140, one or more connections between the various conduits 122 would have to be brazed and then unbrazed and/or cut and then welded in order to change the flow path through the heat exchanger coil 120. The variable circuitry heat exchanger system 140 therefore enables changing the number and/or length of one or more flow paths through the heat exchanger coil 120 in real time using the valves 148.

Figure 9:
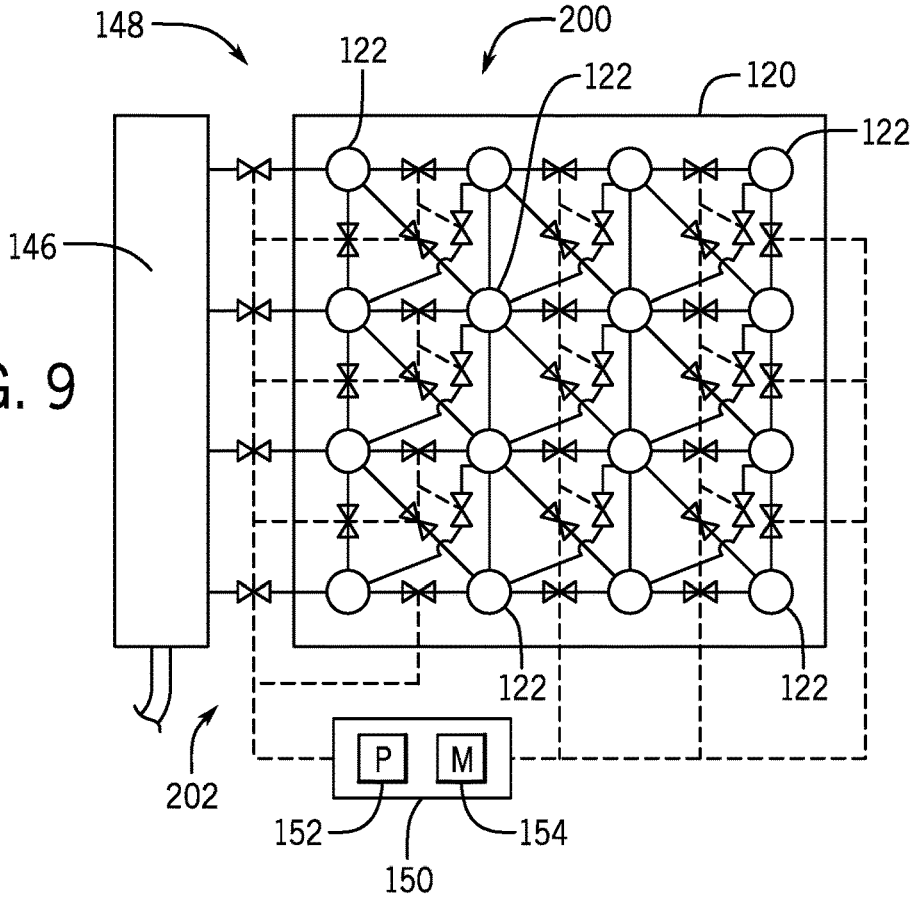
FIG. 9 is a schematic view of an embodiment of a variable circuitry heat exchanger system, in accordance with an aspect of the present disclosure.

FIG. 9 is a schematic view of an embodiment of a variable circuitry heat exchanger system 200. As illustrated, a first row 202 of conduits 122 receives refrigerant from the manifold 146. The flow of refrigerant into the first row 202 of conduits 122 is controlled by respective valves 148. These valves 148 couple to the controller 150, which controls actuation of the valves 148. This enables the controller 150 to adjust which of the conduits 122 in the first row 202 receives refrigerant from the manifold 146. To further manipulate one or more flow paths through the heat exchanger coil 120, the variable circuitry heat exchanger system 200 includes valves 148 between all neighboring, adjacent, or adjoining conduits 122. This forms a spider-like layout that enables each conduit 122 to transfer or not transfer refrigerant to each neighboring conduit 122. In this layout, refrigerant flowing through one conduit 122 may be selectively routed between 0 and 8 neighboring conduits 122. In other words, the flow path(s) of refrigerant through the heat exchanger coil 120 may be changed in multiple ways, including length, number, and position relative to the heat exchanger coil 120. As explained above, the ability to reroute the refrigerant by controlling the valves 148 enables heat transfer optimization in response to an operating mode and/or loading of the HVAC system.

Figure 10:
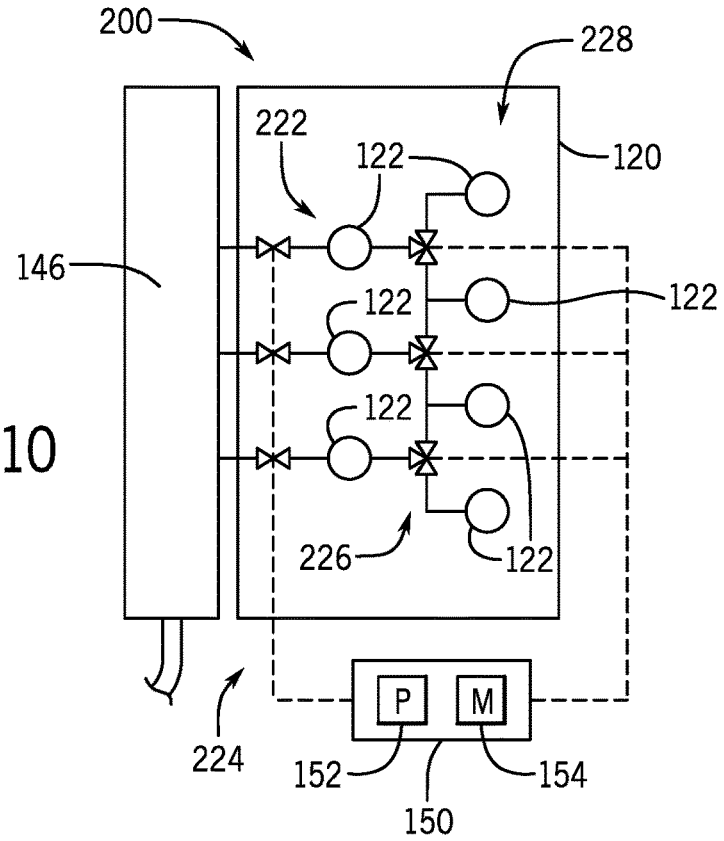
FIG. 10 is a schematic view of an embodiment of a variable circuitry heat exchanger system, in accordance with an aspect of the present disclosure.

FIG. 10 is a schematic view of an embodiment of a variable circuitry heat exchanger system 220. As illustrated, a first row 222 of conduits 122 receives refrigerant from the manifold 146. The flow of refrigerant into the first row 222 of conduits 122 is controlled by one-way valves 224. In operation, the controller 150 controls actuation of the one-way valves 224, and thus controls which of the conduits 122 in the first row 222 receives refrigerant from the manifold 146. By controlling which of the conduits 122 in the first row 222 receives refrigerant, the controller 150 is able to manipulate one or more flow paths of refrigerant through the heat exchanger coil 120. To further manipulate one or more flow paths through the heat exchanger coil 120, the variable circuitry heat exchanger system 220 includes two/three-way valves 226 that couple the first row 222 of conduits to a second row 228 of conduits. The two/three-way valves 226 enable the controller 150 to determine whether refrigerant flowing through one of the conduits 122 in the first row 222 sends refrigerant to conduits 122 in the second row 228. In other words, one, both, or neither of the conduits 122 in the second row 228 receives refrigerant from a respective valve 226. This arrangement forms a branch-like layout that enables fluid flow from one of the conduits 122 in the first row 222 to be directed to multiple rows of conduits 122. It should be understood that in some embodiments, the heat exchanger coil 120 may include additional rows of conduits 122 and the associated valves 224 and/or 226. The ability to reroute the refrigerant by controlling the valves 224 and 226 enables heat transfer optimization depending on the operating mode and loading of the HVAC system.

Figure 11:
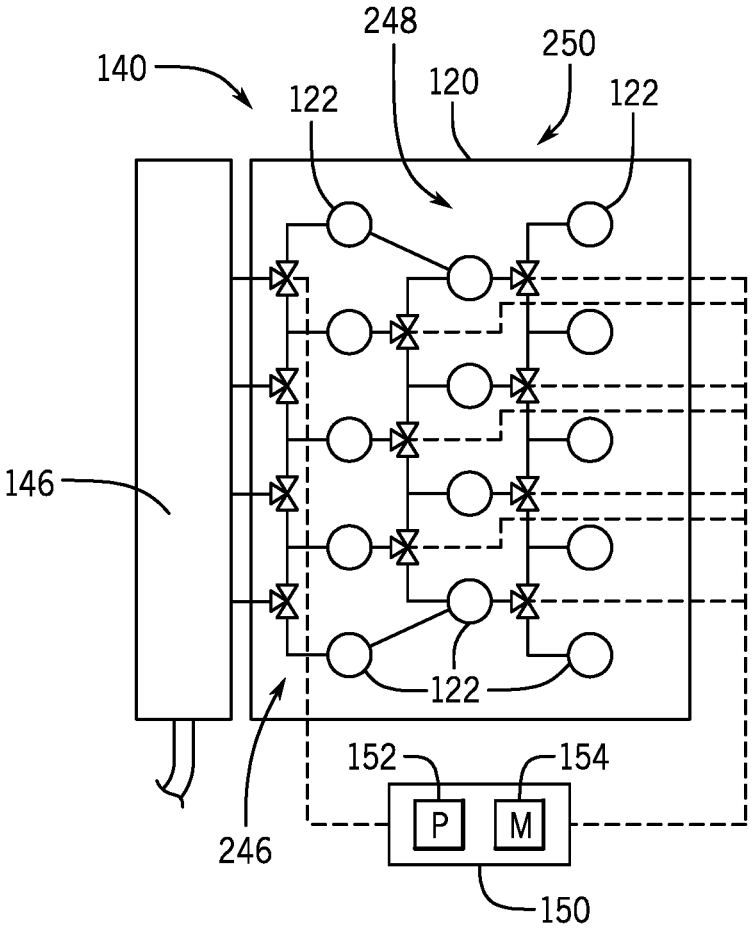
FIG. 11 is a schematic view of an embodiment of a variable circuitry heat exchanger system, in accordance with an aspect of the present disclosure.

FIG. 11 is a schematic view of an embodiment of a variable circuitry heat exchanger system 240. As illustrated, a first row 242 of conduits 122 receives refrigerant from the manifold 146 via two/three-way valves 246. In operation, the controller 150 controls actuation of the two/three-way valves 246 and thus controls whether each two/three-way valve 246 feeds one, two, or no conduits 122 in the first row 242, depending on if the valve 246 is a two-way valve or a three-way valve. By controlling which of the conduits 122 in the first row 242 receives refrigerant, the controller 150 is able to manipulate one or more flow paths of refrigerant through the heat exchanger coil 120. The variable circuitry heat exchanger system 240 may also include additional two/three-way valves 246 that couple the first row 242 of conduits 122 to the second row 248 of conduits 122, and the second row 248 of conduits 122 to the third row 250 of conduits 122. The two/three-way valves 246 enable the controller 150 to determine whether refrigerant flowing through the conduits 122 in the first row 242 sends refrigerant to conduits 122 in the second row 228. In other words, one, two, or none of the conduits 122 in the second row 248 receives refrigerant from a respective valve 246. This arrangement likewise forms a branch\-like layout that enables the conduits 122 in the first row 242 to feed multiple rows of conduits 122 downstream of the first row 242. It should be understood that some embodiments may include additional rows of conduits 122 and the associated valves 246.

The ability to change one or more flow paths through a heat exchanger coil with a variable circuitry heat exchanger system enables an HVAC system to optimize heat transfer in different loading conditions and modes of operation. Furthermore, the variable circuitry heat exchanger system is able to optimize heat transfer from the HVAC system without shutting down the HVAC system to disconnect and then reconnect one or more conduits in the heat exchanger coil.

While only certain features and embodiments of the disclosure have been illustrated and described, many modifications and changes may occur to those skilled in the art, such as variations in sizes, dimensions, structures, shapes and proportions of the various elements, values of parameters, temperatures, pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed subject matter. It should be appreciated that in the development of any such actual implementation, as in any engineering or design project, numerous implementation specific decisions may be made. Such a development effort might be complex and time consuming, but would be a routine undertaking of design, fabrication, and manufacture for those of ordinary skill having the benefit of this disclosure, without undue experimentation.

The invention claimed is:

1. A heat exchanger, comprising:

a plurality of conduits each configured to transmit a refrigerant therethrough; and a valve configured to actuate to fluidly couple a first set of conduits of the plurality of conduits in a first setting and fluidly couple a second set of conduits of the plurality of conduits in a second setting, wherein the first set of conduits and the second set of conduits are different, and wherein the valve comprises a three-way valve configured to:

direct the refrigerant from a first conduit of the plurality of conduits to a second conduit of the plurality of conduits in a first position, and direct the refrigerant from the first conduit of the plurality of conduits to a third conduit of the plurality of conduits in a second position, wherein the first conduit, the second conduit, and the third conduit axially overlap with one another.

2. The heat exchanger of claim 1, comprising a plurality of fins coupled to the plurality of conduits to increase heat transfer.

3. The heat exchanger of claim 1, wherein the first set of conduits and the second set of conduits share at least one conduit of the plurality of conduits.

4. The heat exchanger of claim 1, wherein the first set of conduits comprises a first flow path having a first length, and the second set of conduits comprises a second flow path having a second length different from the first length.

5. The heat exchanger of claim 1, comprising a controller configured to actuate the valve based on a load of an HVAC system.

6. The heat exchanger of claim 1, comprising a controller configured to actuate the valve based on an operating mode of an HVAC system.

7. The heat exchanger of claim 1, wherein the first set of conduits and the second set of conduits axially overlap with each another.

8. A heating, ventilation, and air conditioning (HVAC) system, comprising:

a heat exchanger having a coil, wherein the coil is configured to transmit a refrigerant fluid through a plurality of conduits; and a valve fluidly coupling at least two conduits of the plurality of conduits to actuate and redirect the refrigerant fluid through at least a subset of the plurality of conduits, wherein the valve comprises a three-way valve configured to:

direct the refrigerant fluid from a first conduit of the plurality of conduits to a second conduit of the plurality of conduits in a first position, and direct the refrigerant fluid from the first conduit of the plurality of conduits to a third conduit of the plurality of conduits in a second position, wherein the first conduit, the second conduit, and the third conduit axially overlap with one another.

9. The HVAC system of claim 8, comprising a plurality of fins coupled to the coil and configured to increase heat transfer.

10. The HVAC system of claim 8, comprising a controller configured to actuate the valve based on a load of the HVAC system.

11. The HVAC system of claim 8, comprising a controller configured to actuate the valve based on an operating mode of the HVAC system.

12. The HVAC system of claim 8, wherein the valve is configured to operate in a first state to direct the refrigerant fluid through a first flow path and to operate in a second state to direct the refrigerant fluid through a second flow path, wherein the first flow path and the second flow path share at least one conduit of the plurality of conduits.

13. The HVAC system of claim 12, wherein the first flow path comprises a first length and the second flow path comprises a second length different from the first length.

14. The HVAC system of claim 8, comprising a manifold of the heat exchanger, wherein the manifold is coupled to the plurality of conduits.

15. The HVAC system of claim 8, wherein the valve is a first valve, and further comprising a second valve fluidly coupling at least two additional conduits of the plurality of conduits.

16. A heating, ventilation, and air conditioning (HVAC) system, comprising:

a heat exchanger coil, wherein the heat exchanger coil comprises:

a plurality of conduits configured to transmit a refrigerant therethrough;

a fin coupled to the plurality of conduits; and a three-way valve fluidly coupled to a first conduit, a second conduit, and a third conduit of the plurality of conduits, wherein the three-way valve is configured to actuate and redirect a flow path of the refrigerant from the first conduit to the second conduit of the plurality of conduits in a first position of the three-way valve and from the first conduit to the third conduit of the plurality of conduits in a second position of the three-way valve, wherein the first conduit, the second conduit, and the third conduit of the plurality of conduits axially overlap with one another.

17. The HVAC system of claim 16, comprising a controller coupled to the three-way valve and configured to actuate the three-way valve to adjust the flow path in response to an operating condition of the HVAC system.

18. The HVAC system of claim 16, wherein the three-way valve is configured to fluidly couple a first set of the plurality of conduits comprising the first conduit and the second conduit in the first position and fluidly couple a second set of the plurality of conduits comprising the first conduit and the third conduit in the second position.

19. The HVAC system of claim 18, wherein the first set of the plurality of conduits defines a first flow path length, and the second set of the plurality of conduits comprises a second flow path length different from the first flow path length.

20. The HVAC system of claim 16, wherein the heat exchanger coil is an evaporator coil or a condenser coil.

* * * * *